US010506832B2

(12) United States Patent
Chen

(10) Patent No.: US 10,506,832 B2
(45) Date of Patent: Dec. 17, 2019

(54) ATOMIZER AND ELECTRONIC CIGARETTE HAVING SAME

(71) Applicant: SHENZHEN IVPS TECHNOLOGY CO., LTD., Shenzhen, Guangdong Province (CN)

(72) Inventor: Wen Chen, Shenzhen (CN)

(73) Assignee: SHENZHEN IVPS TECHNOLOGY CO., LTD. (CN)

( * ) Notice: Subject to any disclaimer, the term of this patent is extended or adjusted under 35 U.S.C. 154(b) by 178 days.

(21) Appl. No.: 15/849,601

(22) Filed: Dec. 20, 2017

(65) Prior Publication Data

US 2018/0177237 A1 Jun. 28, 2018

(30) Foreign Application Priority Data

Dec. 27, 2016 (CN) ..... 2016 2 1452909 U

(51) Int. Cl.

| | |
|---|---|
| ***A24F 13/00*** | (2006.01) |
| ***A24F 17/00*** | (2006.01) |
| ***A24F 25/00*** | (2006.01) |
| ***A24F 47/00*** | (2006.01) |
| ***H05B 3/46*** | (2006.01) |

(52) U.S. Cl.

CPC ..... *A24F 47/008* (2013.01); *H05B 3/46* (2013.01)

(58) Field of Classification Search

CPC ..... A24F 47/008; A24F 47/002; H05B 3/46
USPC ..... 131/329, 328
See application file for complete search history.

(56) References Cited

U.S. PATENT DOCUMENTS

| | | | | |
|---|---|---|---|---|
| 9,861,134 | B2 * | 1/2018 | Zhu | A24F 47/008 |
| 10,123,568 | B1 * | 11/2018 | Zhu | A24F 47/008 |
| 2015/0208731 | A1 | 7/2015 | Malamud et al. | |
| 2016/0106153 | A1 * | 4/2016 | Zhu | A24F 47/008 131/329 |
| 2016/0135505 | A1 * | 5/2016 | Li | H05B 3/44 131/329 |
| 2016/0143358 | A1 * | 5/2016 | Zhu | A24F 47/008 131/329 |
| 2019/0142069 | A1 * | 5/2019 | Qiu | A24F 47/008 131/329 |

FOREIGN PATENT DOCUMENTS

| | | |
|---|---|---|
| EP | 3 095 339 A1 | 11/2016 |
| WO | 2013/083638 A1 | 6/2013 |

* cited by examiner

*Primary Examiner* — Hae Moon Hyeon
(74) *Attorney, Agent, or Firm* — IP-PAL Patent US

(57) ABSTRACT

The present invention discloses an atomizer and an electronic cigarette having the same, wherein the atomizer present invention comprises a core assembly. The core assembly defines an air-inlet passage and a smoke-outlet passage at both ends, respectively. At least one atomizing chamber and at least one cooling passage, both of which are communicated with the air-inlet passage and the smoke-outlet passage, respectively, are formed in the core assembly. The at least one atomizing chamber (103) is spaced from the at least one cooling passage (104). The technical solution of the present invention solves the problem that the core assembly of the existing electronic cigarette has a high temperature in use, and improves its using stability and service life.

10 Claims, 6 Drawing Sheets

ATOMIZER AND ELECTRONIC CIGARETTE HAVING SAME

CROSS REFERENCE TO RELATED APPLICATIONS

The present application claims priority to Chinese Patent Application CN 201621452909.1 filed on Dec. 27, 2016.

TECHNICAL FIELD

The present invention relates to the technical field of electronic cigarettes, and in particular to an atomizer and an electronic cigarette having the same.

BACKGROUND

The core assembly of the existing electronic cigarette products will generate smoke during the heating and atomizing process. Because of the high temperature of the smoke, there is a risk of burning; further, if the temperature of the core assembly is too high in use, it will affect its using stability and service life.

SUMMARY

The main object of the present invention is to provide an atomizer, which is intended to solve the problem that the core assembly of the existing electronic cigarette has a high temperature in use, and improve its using stability and service life.

To realize the above object, the present invention provides an atomizer comprising a core assembly. The core assembly defines an air-inlet passage and a smoke-outlet passage respectively at its both ends. At least one atomizing chamber and at least one cooling passage, both of which are communicated with the air-inlet passage and the smoke-outlet passage, respectively, are formed in the core assembly. The at least one atomizing chamber is spaced from the at least one cooling passage.

Preferably the core assembly comprises an atomizing tube, an atomizing seat accommodated in the atomizing tube, and at least one heating assembly accommodated in the atomizing seat. The atomizing tube defines at least one oil-inlet hole. The atomizing chamber and the cooling passage are formed in the atomizing seat. The heating assembly is accommodated in the atomizing chamber, and the atomizer chamber is communicated with the oil-inlet hole.

Preferably the heating assembly comprises an oil-absorbing element and a heating wire, and the heating wire is wrapped by the oil-absorbing element.

Preferably the core assembly further comprises an atomizing cap connected to one end of the atomizing seat, an insulating element partially accommodated in another end of the atomizing seat and a contacting element accommodated in the insulating element.

Preferably the contacting element defines an air-inlet inner hole, and the air-inlet inner hole is communicated with the atomizing chamber.

Preferably the atomizer further comprises an upper-cover assembly, a lower-cover assembly and a sleeve sheathed on the core assembly. The upper-cover assembly is connected to one end of the core assembly and the sleeve. The lower-cover assembly is connected to another end of the core assembly and the sleeve. The core assembly, the upper-cover assembly, the lower-cover assembly and the sleeve together form an oil-storage chamber. The oil-storage chamber is communicated with the atomizing chamber through the oil-inlet hole.

Preferably the lower-cover assembly comprises a lower-cover main body and an adjusting component sheathed on the lower-cover main body. The lower-cover main body defines an air inlet which is communicated with the air-inlet passage. The adjusting component opens or shields the air inlet.

Preferably the upper-cover assembly comprises an upper-cover main body and a dripping nozzle partially accommodated in the upper-cover main body. The upper-cover main body defines a smoke outlet communicated with the smoke-outlet passage. The dripping nozzle defines a suction opening. The suction opening is communicated with the smoke outlet.

Preferably the lower-cover assembly further comprises a conductive component. The conductive component is provided on an end of the lower-cover assembly remote from the core assembly. The conductive component is electrically connected with the heating element.

The present invention further provides an electronic cigarette comprising the atomizer as described above. The electronic cigarette further comprises a battery structure. The atomizer is connected with the battery structure.

The core assembly according to the technical solution of the present invention defines an air-inlet passage and a smoke-outlet passage at its both ends, respectively. At least one atomizing chamber and at least one cooling passage, both of which are communicated with the air-inlet passage and the smoke-outlet passage, respectively, are formed in the core assembly. The at least one atomizing chamber is spaced from the at least one cooling passage. Air passing through the cooling passage may take away a part of heat so as to cool down the atomizer so as to improve its using stability and service life; a part of air entering the atomizer passes through the cooling passage and then is further mixed with smoke generated by atomizing another part of air through the atomizing chamber, thus reducing the temperature of the smoke and preventing burning users suctioning smoke.

BRIEF DESCRIPTION OF THE DRAWINGS

To describe the technical solutions in the embodiments of the present invention or the prior art more clearly, the accompanying drawings required for describing the embodiments or the prior art will be described briefly below. It will be apparent that the accompanying drawings in the following descriptions are merely some embodiments of the present invention. Other accompanying drawings may be obtained according to the structures shown in the accompanying drawings to those skilled in the art without creative efforts.

DESCRIPTION OF REFERENCE NUMERALS

Figure 1:
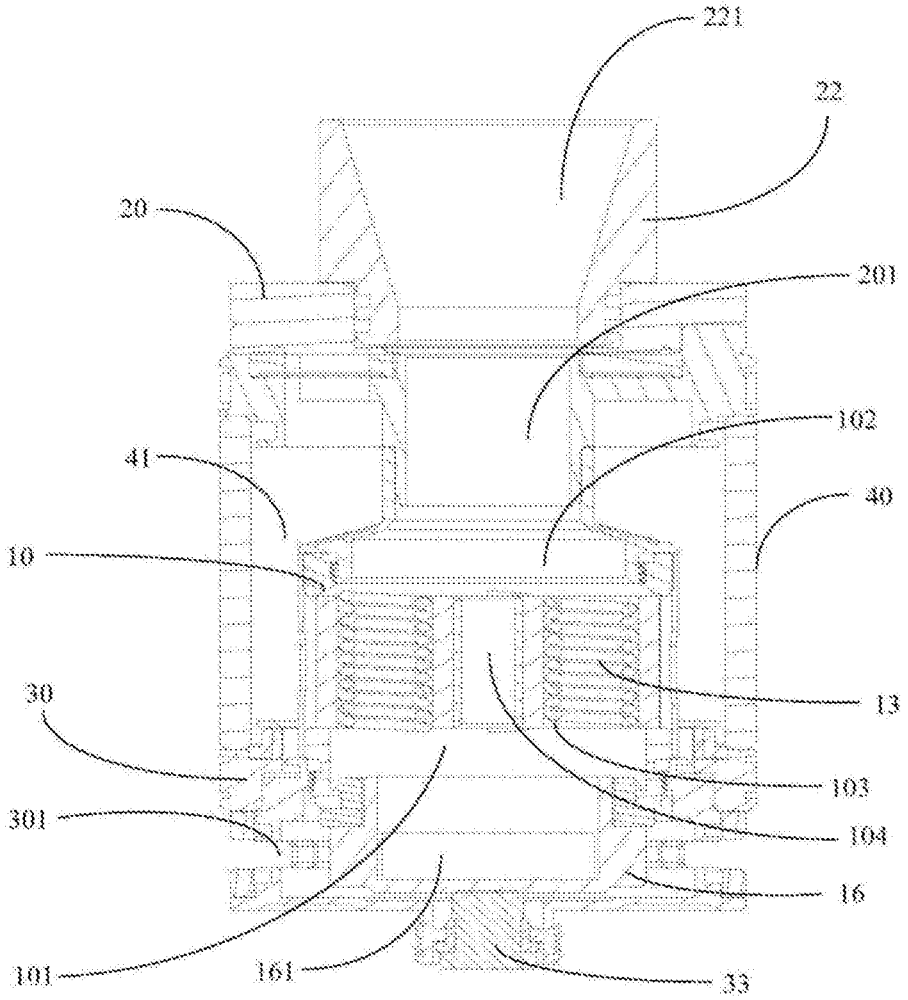
FIG. 1 is a sectional view of a perspective of an embodiment of an atomizer according to the present invention.

| Number | Name |
|---|---|
| 10 | core assembly |
| 101 | an air-inlet passage |
| 102 | smoke-outlet passage |
| 103 | atomizing chamber |
| 104 | cooling passage |
| 11 | atomizing tube |
| 111 | oil-inlet hole |
| 12 | atomizing seat |
| 13 | heating assembly |
| 131 | oil-absorbing element |
| 132 | heating wire |
| 14 | atomizing cap |
| 15 | insulating element |
| 16 | contacting element |
| 161 | air-inlet inner hole |
| 20 | upper-cover assembly |
| 201 | smoke outlet |
| 21 | upper-cover main body |
| 22 | drip nozzle |
| 221 | suction opening |
| 30 | lower-cover assembly |
| 301 | air inlet |
| 31 | lower-cover main body |
| 32 | adjusting component |
| 33 | conductive component |
| 40 | sleeve |
| 41 | oil-storage chamber |

The implementation of the purpose, functional features and advantages of the present invention will be further described in combination with embodiments with reference to the accompanying drawings.

DETAIL DESCRIPTION

The technical solution in the embodiments of the present invention will be clearly and completely described below with reference to the accompanying drawings in the embodiments of the present invention. It is apparent that the described embodiments are merely a part of the embodiments of the present invention, rather than all the embodiments. All other embodiments obtained by those skilled in the art based on the embodiments of the present invention without creative efforts shall fall within the protection scope of the present invention.

It should be noted that, all the directional indicators (such as up, down, left, right, front, rear, etc.) in the embodiments of the present invention are merely used to explain the relative position relation, the movement condition and the like between various components in a specific posture (as shown in the accompanying drawings) and if the specific posture is changed, the directional indicator also changes accordingly.

In addition, the descriptions related to "a first", "a second", and the like in the present invention are merely for the purpose of description and are not to be understood as indicating or implying its relative importance or implied indication of the indicated number of technical features. Thus, features defining "a first" and "a second" may explicitly or implicitly include at least one of the features. In addition, the technical solutions between the various embodiments may be combined with each other, but they must be on the basis of being implementable by those skilled in the art. When the combinations of the technical solutions appear contradictory or cannot be implemented, it should be considered that the combination of the technical solutions does not exist and is not within the protection scope claimed by the present invention.

In the present invention, the terms "connected", "fixed" and the like should be broadly understood unless the context clearly indicates otherwise. For example, "fixed" may be fixedly connected, or may be detachably connected or integrated; it may be mechanical connected or electrical connected; it may be directly connected or indirectly connected through an intermediary medium. It may be an internal communication between two components or an interaction between two components unless otherwise explicitly defined. For those skilled in the art, the specific meanings of the above terms in the present invention may be understood based on specific situations.

Referring to FIGS. 1-6, the present invention provides an atomizer. The atomizer comprises a core assembly 10. The core assembly 10 defines an air-inlet passage 101 and a smoke-outlet passage 102 respectively at its both ends. At least one atomizing chamber 103 and at least one cooling passage 104, both of which are communicated with the air-inlet passage 101 and a smoke-outlet passage 102, respectively, are formed in the core assembly 10. The at least one atomizing chamber 103 is spaced from the at least one cooling passage 104.

The core assembly 10 according to the technical solution of the present invention defines an air-inlet passage 101 and a smoke-outlet passage 102 at its both ends, respectively. At least one atomizing chamber 103 and at least one cooling passage 104, both of which are communicated with the air-inlet passage 101 and the smoke-outlet passage 102, respectively, are formed in the core assembly 10. The at least one atomizing chamber 103 is spaced from the cooling passage 104. Air enters from the air-inlet passage 101 and is mixed and discharged from the smoke-outlet passage 102 after passing through the atomizing chamber 103 and the cooling passage 104, respectively. Air passing through the cooling passage 104 may take away a part of heat so as to cool down the atomizer so as to improve its using stability and service life; a part of air entering the atomizer passes through the cooling passage 104 and then is further mixed with smoke generated by atomizing another part of air through the atomizing chamber 103, thus reducing the temperature of the smoke and preventing burning users suctioning smoke.

Continuing with FIGS. 1-6, the core assembly 10 comprises an atomizing tube 11, an atomizing seat 12 accommodated in the atomizing tube 11 and at least one heating assembly 13 accommodated in atomizing seat 12. The atomizing tube 11 defines at least an oil-inlet hole 111. The atomizing chamber 103 and the cooling passage 104 are formed in the atomizing seat 12. The heating assembly 13 is accommodated in the atomizing chamber 103. The atomizing chamber 103 is communicated with the oil-inlet hole 111.

Specifically, the atomizing tube 11 is sheathed on the atomizing seat 12 tightly.

Preferably, there are four atomizing chambers 103, and there is one cooling passage 104. The atomizing chamber 103 is provided around the cooling passage 104.

The atomizing tube 11 according to the technical solution of the present invention defines at least one oil-inlet hole 111. The atomizing chamber 103 and the cooling passage 104 are defined in the atomizing seat 12. The heating assembly 13 is accommodated in the atomizing chamber 103. The atomizing chamber 103 is communicated with the oil-inlet hole 111. The oil enters the atomizing chamber 103 through the oil-inlet hole 111. The heating assembly 13 supplies enough heat to atomize the oil so as to generate atomized smoke. Air passing through the cooling passage 104 may take away a part of heat so as to cool down the atomizer so as to improve its using stability and service life; a part of air entering the atomizer passes through the cooling passage 104 and then is further mixed with smoke generated by atomizing another part of air through the atomizing chamber 103, thus reducing the temperature of the smoke and preventing burning users suctioning smoke.

Figure 4:
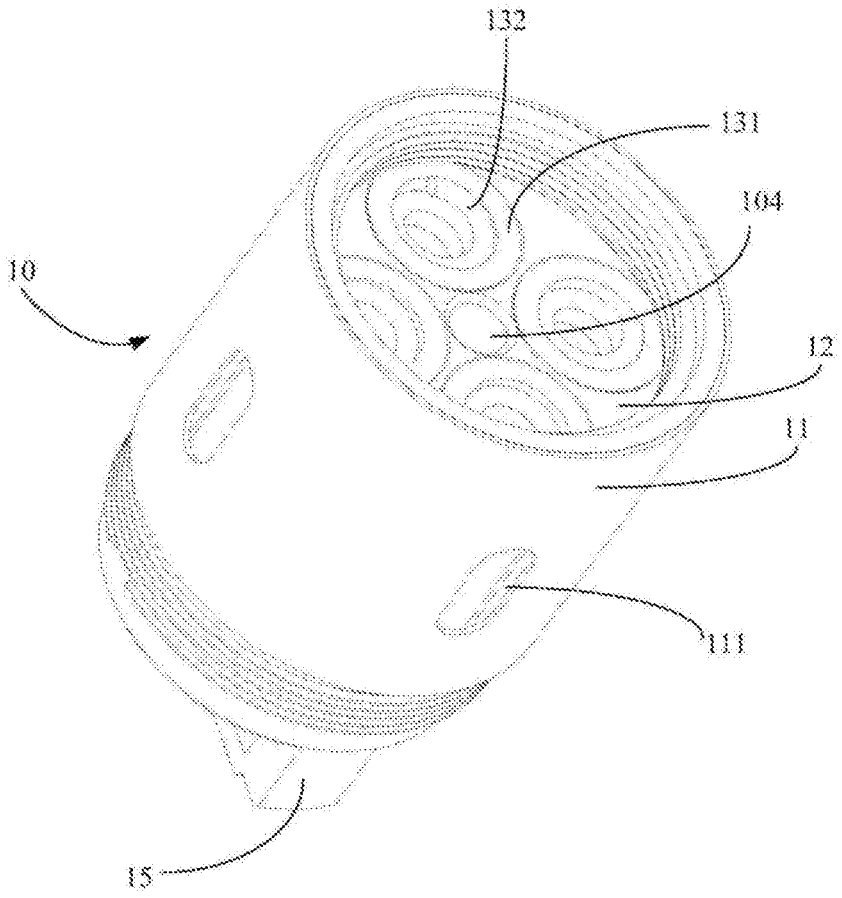
FIG. 4 is a structural schematic diagram of a core assembly in an embodiment of an atomizer according to the present invention.
Figure 5:
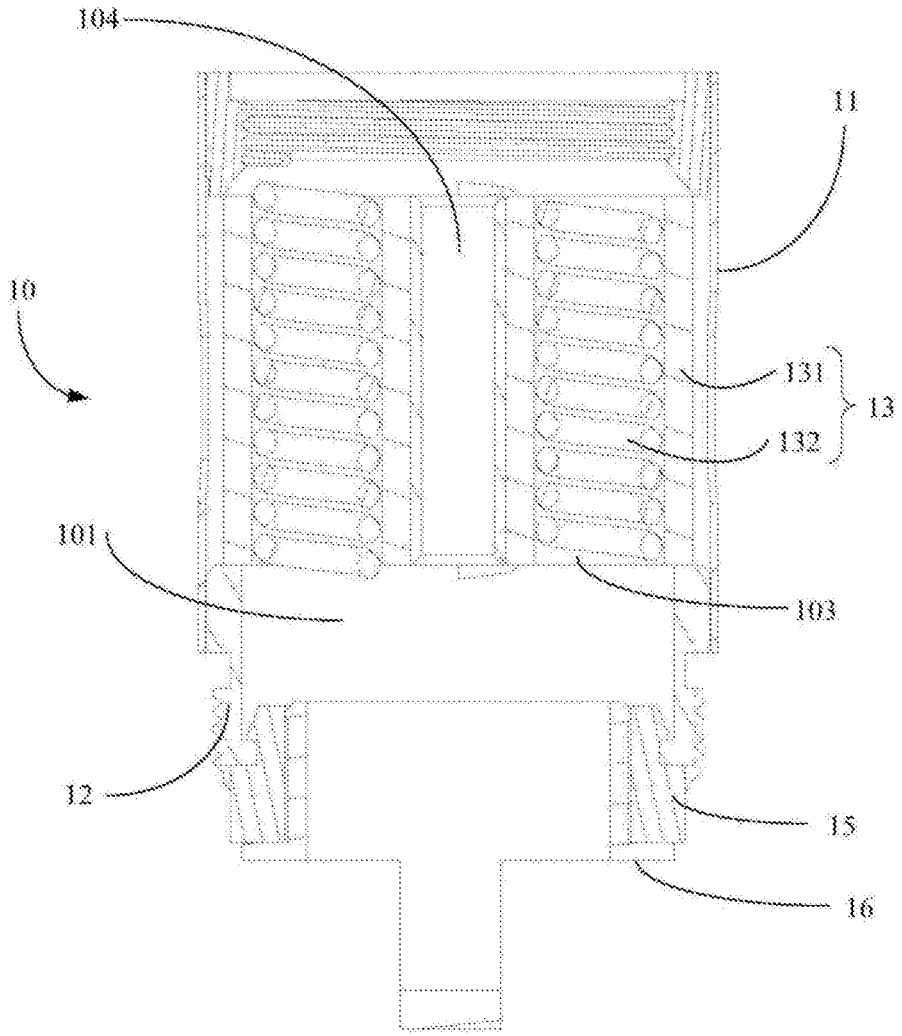
FIG. 5 is a sectional view of a core assembly in an embodiment of an atomizer according to the present invention.
Figure 6:
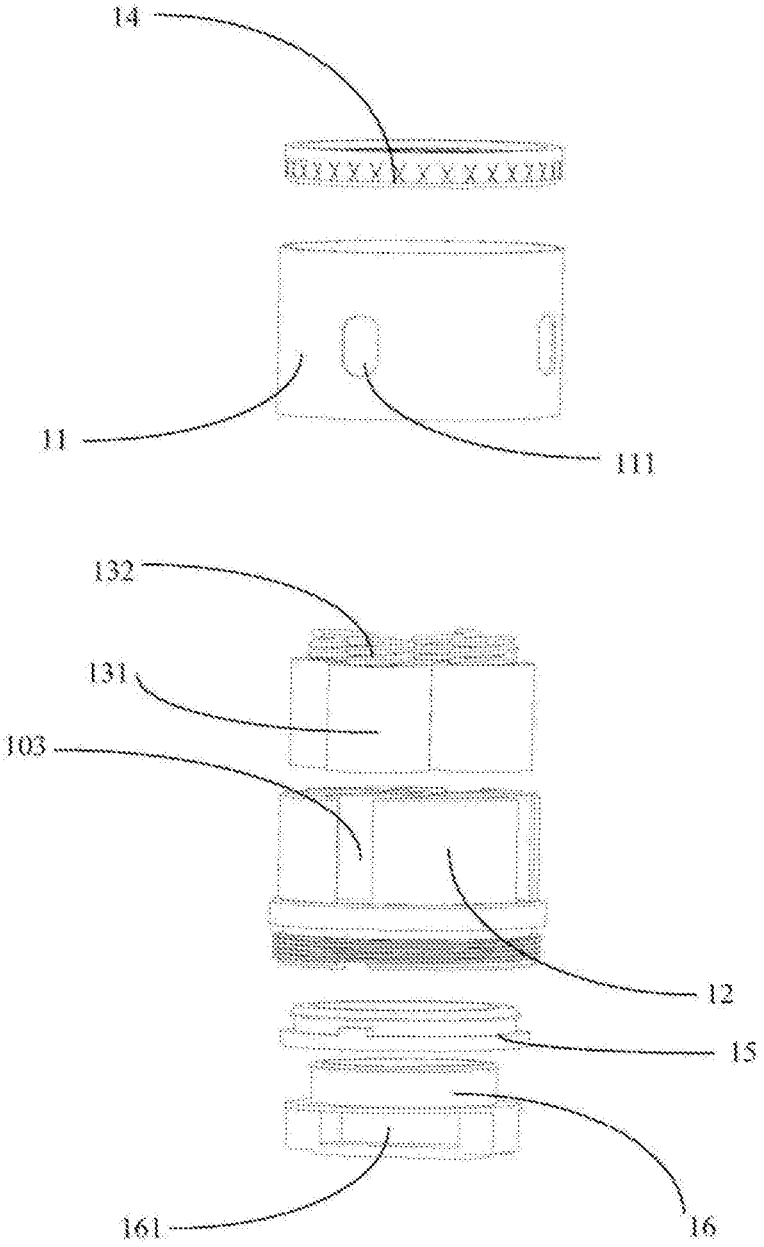
FIG. 6 is an explosive view of a core assembly in an embodiment of an atomizer according to the present invention.

Referring to FIGS. 4-6, the heating assembly 13 comprises an oil-absorbing element 131 and a heating wire 132. The heating wire 132 is wrapped by the oil-absorbing element 131.

Specifically, the oil-absorbing element 131 is made of a material which has a performance in oil absorption, such as dust-free paper, oil-absorbing cotton and so on.

According to the technical solution of the present invention, the heating wire 132 is wrapped by the oil-absorbing element 131, and the oil-absorbing element 131 has a good performance in oil absorption so as to provide enough oil required for the heating wire 132 to atomize, greatly improving the atomizing effect.

Referring to FIGS. 5-6, the core assembly 10 further comprises an atomizing cap 14 connected to one end of the atomizing seat 12, an insulating element 15 partially accommodated in another end of the atomizing seat 12, and a contacting element 16 accommodated in the insulating element 15.

Specifically, the atomizing cap 14 is resisted against one end of the atomizing tube 11, and the atomizing seat 12 is resisted against another end of the atomizing tube 11.

According to the technical solution of the present invention, the atomizing cap 14 is connected with one end of the atomizing seat 12 so as to fix the atomizing tube 11 tightly on the atomizing seat 12; and the insulating element 15 and the contacting element 16 are partially accommodated in another end of the atomizing seat 12. The contacting element 16 is accommodated in the insulating element 15. The contacting element 16 is used to be electrically connected to the heating assembly 13. The insulating element 15 is used to insulate the bottom of the atomizing seat 12 from the contacting element 16.

Referring to FIGS. 1 and 6, the contacting element 16 defines an air-inlet inner hole 161. The air-inlet inner hole 161 is communicated with the atomizing chamber 103.

According to the technical solution of the present invention, the contacting element 16 defines an air-inlet inner hole 161, and the air-inlet inner hole 161 is communicated with the atomizing chamber 103. The air enters the atomizing chamber 103 through the air-inlet inner hole 161, providing enough air for atomizing oil and ensuring that the core assembly 10 is atomized normally.

Continuing with FIGS. 1-6, the atomizer further comprises an upper-cover assembly 20, a lower-cover assembly 30 and a sleeve 40 which is sheathed on the core assembly 10. The upper-cover assembly 20 is connected to one end of the core assembly 10 and the sleeve 40, and the lower-cover assembly 30 is connected to the other end of the core assembly 10 and sleeve 40. The core assembly 10, the upper-cover assembly 20, the lower-cover assembly 30 and the sleeve 40 together form an oil-storage chamber 41. The oil-storage chamber 41 is communicated with the atomizing chamber 103 through oil-inlet hole 111.

According to the technical solution of the present invention, the core assembly 10, the upper-cover assembly 20, the lower-cover assembly 30 and the sleeve 40 together form the oil-storage chamber 41. The oil-storage chamber 41 is communicated with the atomizing chamber 103 through the oil-inlet hole 111. After the atomizer is installed, oil is injected into the oil-storage chamber 41. The oil stored in the oil-storage chamber 41 enters the atomizing chamber 103 through oil-inlet hole 11 so as to provide oil required for the heating assembly 13 accommodated in the atomizing chamber 103 to atomize.

Figure 2:
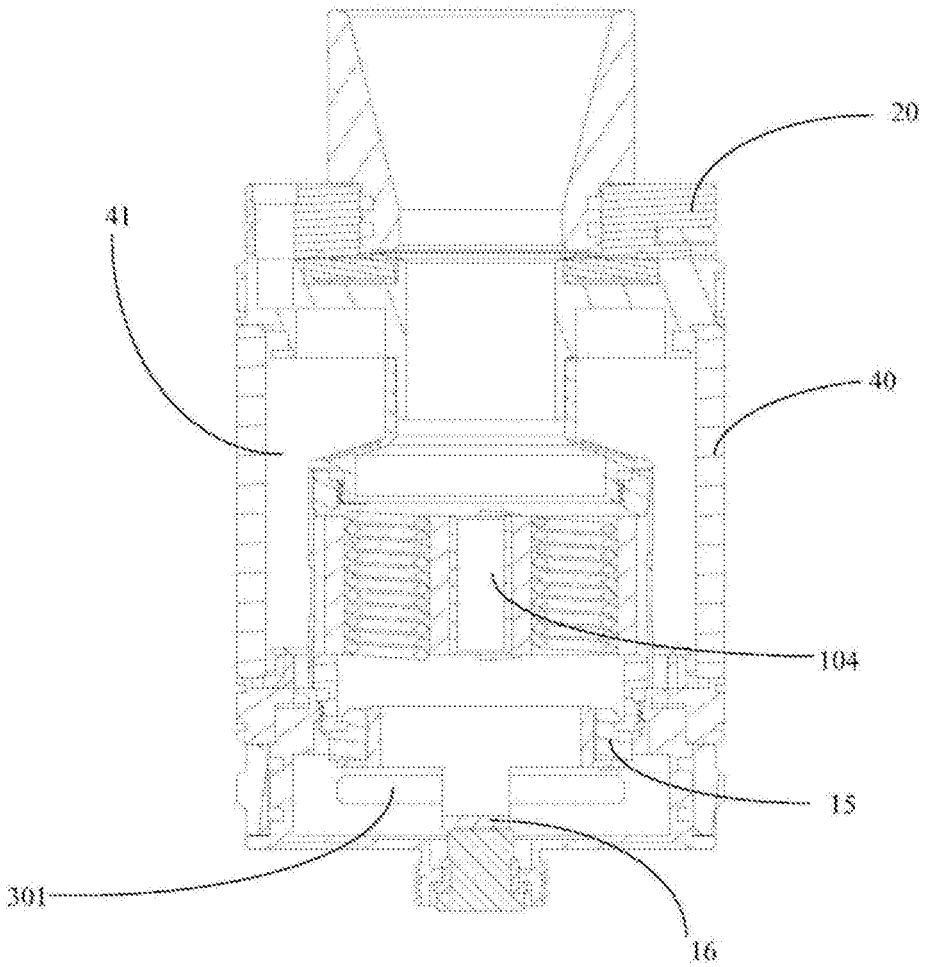
FIG. 2 is a sectional view of another perspective of an embodiment of an atomizer according to the present invention.
Figure 3:
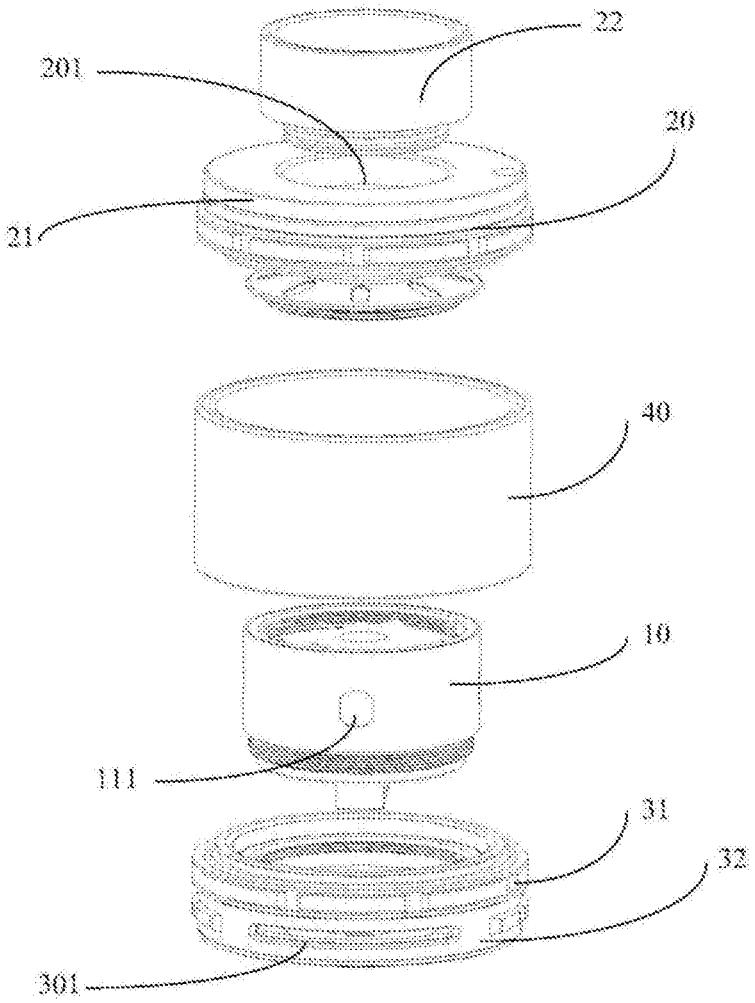
FIG. 3 is an explosive view of an embodiment of an atomizer according to the present invention.

Referring to FIGS. 1-3, the lower-cover assembly 30 comprises a lower-cover main body 31 and an adjusting component 32 sheathed on the lower-cover main body 31. The lower-cover main body 31 defines an air inlet 301 which is communicated with the air-inlet passage 101. The adjusting component 32 opens or shields the air inlet 301.

According to the technical solution of the present invention, the lower-cover main body 31 defines an air inlet 301 which is communicated with the air-inlet passage 101, and the adjusting component 32 opens or shields the air inlet 301. Preferably, the adjusting component 32 is rotatably provided on the lower-cover main body 31. The adjusting component 32 is rotated to adjust the size of the opening exposed by the air inlet 301 so as to adjust the amount of input air. The user may adjust the absorbed smoke concentration according to personal requirement.

Continuing with FIGS. 1-3, the upper-cover assembly 20 comprises an upper-cover main body 21 and a dripping nozzle 22 which is partially accommodated in the upper-cover main body 21. The upper-cover main body 21 defines a smoke outlet 201 which is communicated with the smoke-outlet passage 102. The drip nozzle 22 defines a suction opening 221, and the suction opening 221 is communicated with the smoke outlet 201.

According to the technical solution of the present invention, the upper-cover main body 21 defines a smoke outlet 201 which is communicated with a smoke-outlet passage 102. The drip nozzle 22 defines a suction opening 221, and the suction opening 221 is communicated with the smoke outlet 201. When a user is smoking, the smoke sprayed from the smoke outlet 201 is suctioned into the mouth of the user through the suction opening 221 for suction.

Referring to FIG. 1, the lower-cover assembly 30 further comprises a conductive component 33. The conductive component 33 is provided on an end of the lower-cover assembly 30 remote from the core assembly 10, and the conductive component 33 is electrically connected with the heating element 13.

According to the technical solution of the present invention, the conductive component 33 is electrically connected with the heating element 13. After the atomizer is installed, the heating assembly 13 is electrically connected with battery by the conductive component 33 so as to provide power for the heating assembly 13 and ensure that the atomizer works normally.

It will be understood that, the air passes through the air inlet 301, the air-inlet inner hole 161, and the air-inlet passage 101 in sequence, and then passes through the atomizing chamber 103 and the cooling passage 104. further, the air is mixed in the smoke-outlet passage 102, passes through the smoke outlet 201, and is discharged by the suction opening 221.

The present invention further provides an electronic cigarette. The electronic cigarette comprises the above atomizer. The specific structure of the atomizer is described with reference to the above embodiments. All the beneficial effects of the technical solutions of the above embodiments are achieved because the electronic cigarette adopts all the technical solutions of all the above embodiments, which will not be described in detail herein. The electronic cigarette further includes a battery structure (not shown), and the atomizer is connected to the battery structure.

Specifically, the heating assembly 13 is electrically connected with the battery structure, and the battery structure supplies power to the heating assembly 13.

The above is only the preferred embodiments of the present invention, rather than limiting the patent scope of the present invention. All the equivalent structure transformations made with the use of the specification and the content of the accompanying drawings of the present invention in the concept of the present invention, which are directly/indirectly applied in other related technical fields, are included within the scope of the patent protection of the present invention.

What is claimed is:

1. An atomizer, wherein the atomizer comprises a core assembly, the core assembly defines an air-inlet passage and a smoke-outlet passage at both ends, respectively, at least one atomizing chamber and at least one cooling passage, both of which are communicated with the air-inlet passage and the smoke-outlet passage, respectively, are formed in the core assembly, and the atomizing chamber is spaced from the at least one cooling passage.

2. The atomizer according to claim 1, wherein the core assembly comprises:

an atomizing tube;

an atomizing seat accommodated in the atomizing tube; and at least one heating assembly accommodated in the atomizing seat, wherein the atomizing tube defines at least one oil-inlet hole, the atomizing chamber and the cooling passage are defined in the atomizing seat, the heating assembly is accommodated in the atomizing chamber, and the atomizing chamber is communicated with the oil-inlet hole.

3. The atomizer according to claim 2, wherein the heating assembly comprises an oil-absorbing element and a heating wire, and the heating wire is wrapped by the oil-absorbing element.

4. The atomizer according to claim 2, wherein the core assembly further comprises:

an atomizing cap connected to one end of the atomizing seat;

an insulating element partially accommodated in another end of the atomizing seat; and a contacting element accommodated in the insulating element.

5. The atomizer according to claim 4, wherein the contacting element defines an air-inlet inner hole, and the air-inlet inner hole is communicated with the atomizing chamber.

6. The atomizer according to claim 2, wherein the atomizer further comprises:

an upper-cover assembly;

a lower-cover assembly; and a sleeve sheathed on the core assembly, wherein the upper-cover assembly is connected to one end of the core assembly and the sleeve, the lower-cover assembly is connected to another end of the core assembly and the sleeve, the core assembly, the upper-cover assembly, the lower-cover assembly and the sleeve together form an oil-storage chamber, the oil-storage chamber is communicated with the atomizing chamber through the oil-inlet hole.

7. The atomizer according to claim 6, wherein the lower-cover assembly comprises a lower-cover main body and an adjusting component sheathed on the lower-cover main body, the lower-cover main body defines an air inlet communicated with the air-inlet passage, and the adjusting component opens or shields the air inlet.

8. The atomizer according to claim 6, wherein the upper-cover assembly comprises an upper-cover main body and a dripping nozzle partially accommodated in the upper-cover main body, the upper-cover main body defines a smoke outlet communicated with the smoke-outlet passage, the dripping nozzle defines a suction opening, and the suction opening is communicated with the smoke outlet.

9. The atomizer according to claim 6, wherein the lower-cover assembly further comprises a conductive component, the conductive component is provided on an end of the lower-cover assembly remote from the core assembly, and the conductive component is electrically connected with the heating element.

10. An electronic cigarette, wherein the electronic cigarette comprises the atomizer according to claim 1, the electronic cigarette further comprises a battery structure, and the atomizer is electrically connected with the battery structure.

* * * * *